US005325823A

United States Patent [19]

Garcia-Mallol

[11] Patent Number: 5,325,823

[45] Date of Patent: * Jul. 5, 1994

[54] LARGE SCALE FLUIDIZED BED REACTOR

[75] Inventor: Juan A. Garcia-Mallol, Morristown, N.J.

[73] Assignee: Foster Wheeler Energy Corporation, Clinton, N.J.

[ * ] Notice: The portion of the term of this patent subsequent to Jun. 15, 2010 has been disclaimed.

[21] Appl. No.: 996,284

[22] Filed: Dec. 24, 1992

[51] Int. Cl.[5] ..... F22B 1/00

[52] U.S. Cl. ..... 122/4 D; 165/104.16; 422/146; 110/245

[58] Field of Search ..... 122/4 D; 165/104.16; 422/146; 431/7; 110/245; 432/15

[56] References Cited

U.S. PATENT DOCUMENTS

| | | | |
|---|---|---|---|
| Re. 33,230 | 6/1990 | Engstrom et al. | 110/299 |
| 4,338,283 | 7/1982 | Sakamoto et al. | 422/112 |
| 4,672,918 | 6/1987 | Engstrom et al. | 122/4 D |
| 4,755,134 | 7/1988 | Engstrom et al. | 431/170 |
| 4,815,418 | 3/1989 | Maeda et al. | 122/4 D |
| 4,854,854 | 8/1989 | Jonsson | 431/170 |
| 4,955,295 | 9/1990 | Abdulally | 110/263 |
| 5,005,528 | 4/1991 | Virr | 122/4 D |
| 5,069,170 | 12/1991 | Gorzegno et al. | 122/40 |
| 5,095,854 | 3/1992 | Dietz | 122/40 |
| 5,108,712 | 4/1992 | Alliston et al. | 422/141 |
| 5,141,708 | 8/1992 | Campbell et al. | 422/142 |
| 5,174,799 | 12/1992 | Garcia-Mallol | 55/262 |
| 5,218,931 | 6/1993 | Gorzegno | 122/4 D |

*Primary Examiner*—Henry A. Bennet
*Assistant Examiner*—William C. Doerrler
*Attorney, Agent, or Firm*—Marvin A. Naigur

[57] ABSTRACT

A fluidized bed reactor in which partitions disposed within a vessel form first and second furnace sections, first and second troughs and a heat exchange section such that the first trough is disposed between the first furnace section and the heat recovery section and the second trough is disposed between the second furnace section and the heat recovery section. A fluidized bed is formed in each of the furnace sections for the combustion of fuel to generate heat and to generate a mixture of combustion gases and entrained particulate solids. The mixtures from the furnace sections are received in first and second horizontal cyclone separators, both formed within the vessel for separating the entrained particulate solids from the combustion gases. Outlets extend from the horizontal cyclones to discharge the separated solids to the first and second troughs, respectively. The troughs are divided into first and second sets of compartments with slanted roofs disposed between the cyclone separators and the second sets of compartments for directing the separated solids into the first sets of compartments. Openings are formed in the partitions for permitting the passage of the separated solids from the first sets of compartments into the heat recovery section, for permitting the passage of the separated solids from the heat recovery section to the second sets of compartments, and for permitting the passage of the separated solids from the second sets of compartments to the first and second furnace sections.

32 Claims, 2 Drawing Sheets

LARGE SCALE FLUIDIZED BED REACTOR

FIELD OF THE INVENTION

This invention relates in general to fluidized bed steam generation systems, and, more particularly, relates to a large scale fluidized bed steam reactor which includes, all in a single vessel, two horizontal cyclone separators for separating solid particles from the flue gases generated by the combustion of fuel, two integral recycle heat exchangers for removing heat from the separated solids, and two heat recovery areas for removing heat from the flue gases.

BACKGROUND OF THE INVENTION

Fluidized bed combustion reactors are well known. These arrangements include a furnace section in which air is passed through a bed of particulate material, including a fossil fuel, such as coal, and a sulfur adsorbent, such as limestone, to fluidize the bed and to promote the combustion of the fuel at relatively low temperatures. When the heat produced by the fluidized bed is utilized to convert water to steam, such as in a steam generator, the fluidized bed reactor offers an attractive combination of high heat release, high sulfur adsorption, low nitrogen oxides emissions and fuel flexibility.

The most typical fluidized bed reactor includes what is commonly referred to as a bubbling fluidized bed in which a bed of particulate material is supported by an air distribution plate, to which combustion supporting air is introduced through a plurality of perforations in the plate, causing the material to expand and take on a suspended, or fluidized, state. The hot flue gases produced by the combustion of the fuel are passed to a heat recovery area to utilize their energy. Since the heat recovery area is usually separated from the furnace section, numerous expansion joints are required to connect the heat recovery area to the reactor in order to reduce stresses caused by the high temperature differentials. Heat losses are also encountered.

In the event the reactor is in the form of a steam generator, the walls of the reactor are formed by a plurality of heat transfer tubes. The heat produced by combustion within the fluidized bed is transferred to a heat exchange medium, such as water, circulating through the tubes. The heat transfer tubes are usually connected to a natural water circulation circuitry, including a steam drum, for separating the steam thus formed which steam is then combined with the steam produced in the heat recovery area and routed to a steam user or to a turbine to generate electricity.

In an effort to extend the improvements in combustion efficiency, pollutant emissions control, and operation turn-down afforded by the bubbling bed, a circulating fluidized bed reactor has been developed utilizing a highly expanded and elutriating fluidized bed. According to this technique, the fluidized bed density may be below that of a typical bubbling fluidized bed, with the air velocity equal to or greater than that of a bubbling bed. The formation of the low density elutriating fluidized bed is due to its small particle size and to a high solids throughput, a result of the flue gases entraining the fine particulate solids. This high solids throughput requires greater solids recycling which is achieved by disposing a separator at the furnace section outlet to receive the flue gases, and the solids entrained therein, from the fluidized bed. The solids are separated from the flue gases in the separator and the flue gases are passed to a heat recovery area while the solids are recycled back to the furnace.

The high solids circulation required by the circulating fluidized bed makes it insensitive to fuel heat release patterns, thus minimizing the variation of the temperature within the reactor, and therefore decreasing the formation of nitrogen oxides. Also, this high solids recycling improves the efficiency of the separator. The resulting increase in sulfur adsorbent and fuel residence times reduces the consumption of adsorbent and fuel. Furthermore, the circulating fluidized bed inherently has more turn-down capability than the bubbling fluidized bed.

U.S. Pat. Nos. 4,809,623 and 4,809,625, assigned to the same assignee as the present application, disclose a fluidized bed reactor in which a dense, or bubbling, fluidized bed is maintained in the lower portion of the furnace section, while the bed is otherwise operated as a circulating fluidized bed. This "hybrid" design is such that advantages of both a bubbling bed and a circulating bed are obtained, not the least significant advantage being the ability to utilize particulate fuel material extending over a greater range of particle sizes.

In the operation of these types of fluidized beds, and, more particularly, those of the circulating and hybrid types, there are several important considerations. For example, the flue gases and entrained solids must be maintained in the furnace section at a particular temperature (usually approximately 1600° F.) consistent with proper sulfur capture by the adsorbent. As a result, the maximum heat capacity (head) of the flue gases passed to the heat recovery area and the maximum heat capacity of the separated solids recycled through the separator to the furnace section are limited. In a cycle requiring only superheat duty and no reheat duty, the heat content of the flue gases at the furnace section outlet is usually sufficient to provide the necessary heat for use in the heat recovery area of the steam generator downstream of the separator. Therefore, the heat content of the recycled solids is not needed.

However, in a steam generator using a circulating or hybrid fluidized bed with sulfur capture and a cycle that requires reheat duty as well as superheater duty, the existing heat available in the flue gases at the furnace section outlet is often not sufficient. At the same time, heat in the reactor separator recycle loop is in excess of the steam generator duty requirements. For such a cycle, the design must be such that the heat in the recycled solids be utilized before the solids are reintroduced to the furnace section.

To provide this extra heat capacity, a recycle heat exchanger is sometimes located between the separator solids outlet and the fluidized bed of the furnace section. The recycle heat exchanger includes heat exchange surfaces and receives the separated solids from the separator and functions to transfer heat from the solids to the heat exchange surfaces at relatively high heat transfer rates before the solids are reintroduced to the furnace section. The heat acquired by the heat exchange surfaces is then transferred to cooling circuits to supply reheat and/or superheat duty.

A recycle heat exchanger can offer an extra benefit if constructed to act as a pressure sealing device. Such a sealing device is required between the low pressure separator solids outlet and the higher pressure furnace section of the reactor to prevent solids backflow and furnace section pressure fluctuations from adversely affecting the operating characteristics of either the separator or the furnace section.

There are, however, some disadvantages associated with the use of recycle heat exchangers. For example, a dedicated structure must be employed to house the recycle heat exchanger which must be fully insulated and include a fluidization system. Further, the structure housing the recycle heat exchanger must be interconnected with the rest of the reactor by costly expansion seal assemblies. In addition, if the recycle heat exchanger is to be used as a pressure sealing device, complex and costly structures are required, usually comprising individual chambers, for accomplishing the sealing function and the heat removal function, as well as to allow the solids to bypass the heat exchange surfaces during start-up.

Besides sometimes requiring recycle heat exchangers, circulating or hybrid fluidized bed combustion reactors also require relatively large separators for the separation of the entrained solid particles from the flue gases and for the solids recycle. A cyclone separator is commonly used which includes a vertically oriented, cylindrical vortex chamber in which a central gas outlet pipe is disposed for carrying the separated gases upwardly, while the separated particles exit the separator through its base. These so-called vertical cyclone separators are substantial in size and eliminate the possibility of a compact system design which can be modularized and easily transported and erected. For larger combustion systems, several vertical cyclone separators are often required to provide adequate particle separation, which compound the size problem and, in addition, usually require complicated gas duct arrangements which reduce operating efficiency. These ducts also require substantial amounts of costly refractory insulation to minimize heat loses and expansion seal assemblies to reduce thermal stresses.

Other problems also exist with the use of vertical cyclone separators since they require costly and complex components to deliver the separated particles back to the reactor's fluidized bed. In the absence of a recycle heat exchanger which functions as a sealing device, a gravity chute or a pneumatic transport system is required which must include a sealing device such as a sealpot, a siphon seal or a "J" or "L" valve due to the pressure differential between the low pressure cyclone discharge and the high pressure furnace section. Expansion joints are also required to connect the separator to the chute or transport system to reduce stresses caused by the high temperature differentials experienced.

To eliminate many of the above mentioned problems, horizontal cyclone separators characterized by a horizontally-oriented vortex chamber have been constructed. Horizontal cyclone separators may be readily configured within the upper portion of the furnace section and integrated with the walls of the furnace. However, known horizontal cyclone separators have various shortcomings, particularly with providing recycle heat exchange with the separated solids before the solids are reintroduced to the furnace section.

SUMMARY OF THE INVENTION

It is therefore an object of the present invention to provide a fluidized bed reactor which utilizes a recycle heat exchanger disposed integrally with the furnace section of the reactor.

It is a further object of the present invention to provide a fluidized bed reactor of the above type in which heat exchange surfaces are provided in the recycle heat exchanger to remove heat from the separated solids to control the temperature of the separated solids and provide additional heat to a fluid circuit associated with the reactor.

It is a still further object of the present invention to provide a fluidized bed reactor of the above type in which the recycle heat exchanger includes bypass means for routing the separated solids to the furnace section without passing over any heat exchange surfaces.

It is a still further object of the present invention to provide a fluidized bed reactor of the above type in which the recycle heat exchanger bypass means functions as a pressure sealing device between the separator and the furnace section.

It is a still further object of the present invention to provide a fluidized bed reactor of the above type which eliminates the need for pneumatic transport devices between the separator and the furnace section of the reactor.

It is a still further object of the present invention to provide a fluidized bed reactor of the above type which eliminates the need for expansion joints to connect either the separator or the heat recovery area to the reactor.

It is a still further object of the present invention to provide a fluidized bed reactor of the above type in which conventional cyclone separators are replaced with horizontal cyclone separators.

It is a still further object of the present invention to provide a fluidized bed reactor which is relatively compact in size, can be modularized and is relatively easy to erect.

It is a still further object of the present invention to provide a fluidized bed reactor of the above type in which the bulk, weight and cost of the cyclone separators are much less than that of conventional separators.

It is a still further object of the present invention to provide a fluidized bed reactor of the above type in which heat losses are minimized.

It is a still further object of the present invention to provide a fluidized bed reactor of the above type having multiple furnace sections in which reactor output can be efficiently reduced by operating, at regular load, fewer than all of the furnace sections rather than operating the reactor at low load conditions.

It is a still further object of the present invention to provide a fluidized bed reactor of the above type having multiple furnace sections in which the furnace sections can be operated at different temperatures to provide greater control of the temperatures of the combustion gases passing through the heat recovery areas.

It is a still further object of the present invention to provide a fluidized bed reactor of the above type having multiple furnace sections in which one furnace section can be used to preheat other furnace sections.

It is a still further object of the present invention to provide a fluidized bed reactor of the above type which is utilized to generate steam and, in particular, to provide a very large fluidized bed steam generator system in the range of 500 MW and larger.

Toward the fulfillment of these and other objects, the fluidized bed reactor of the present invention includes an enlarged furnace section, two horizontal cyclone separators, two heat exchange sections disposed on either sides of the furnace section, and two heat recovery areas, all formed within one vessel. A bed of solid particulate material including fuel is supported in the furnace section and air is introduced into the bed at a velocity sufficient to fluidize the material and support the combustion or gasification of the fuel. A mixture of air, the gaseous products of the combustion, and solid particles entrained by the air and the gaseous products is directed from the bed to either of the horizontal cyclone separators which are located above the bed in the upper portion of the vessel.

The horizontal cyclone separators include vortex chambers having inlet ducts which extend the full width of their respective furnace sections for receiving the mixture and separating the particles from the mixture by centrifugal action. Central outlet cylinders are provided for directing the clean gases out of the chambers and into one of the heat recovery areas so that their heat can be productively utilized. The particles separated from the mixture fall from the separators through outlet ducts and settle in troughs which extend between the furnace section and each heat exchange section. The heat exchange sections are partitioned into two segments, a heat recovery segment and a seal pot segment, each segment being independently fluidized by plenum chambers extending beneath the heat exchange sections. Plenum chambers also extend beneath the troughs for selectively fluidizing the separated particles contained in the troughs to direct the separated particles into either the heat recovery segment or the seal pot segment of the respective heat exchange sections.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings in which.

DESCRIPTION OF THE PREFERRED EMBODIMENT

Figure 1:
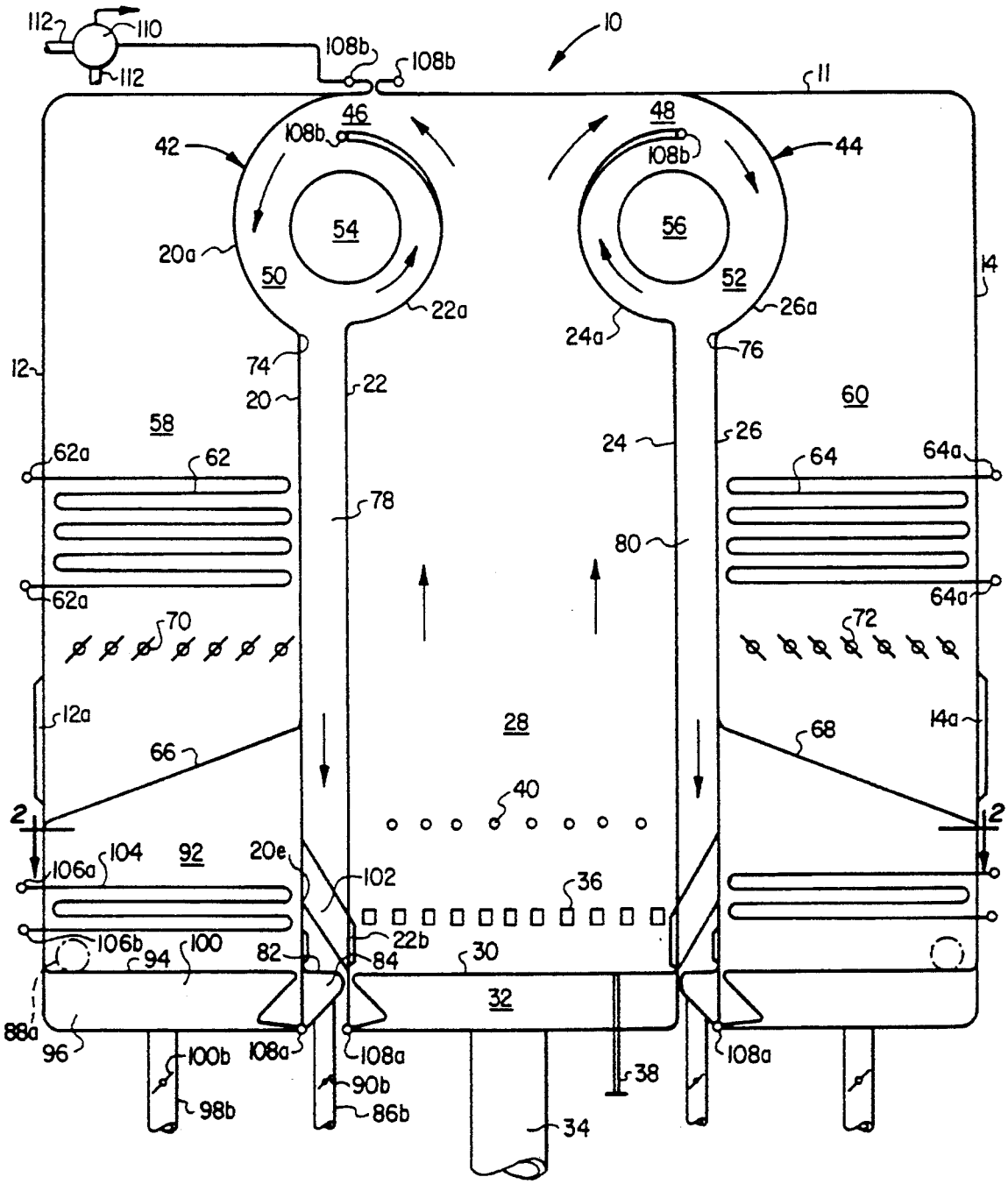
FIG. 1 is a schematic view, partially in section, showing the fluidized bed reactor of the present invention.

Referring to FIG. 1 of the drawings, the reference numeral 10 refers to the fluidized bed reactor of the present invention, which reactor 10 forms a portion of and is in fluid flow connection with a steam generating system.

The reactor 10 includes a generally rectangular vessel defined by a roof 11, a front wall 12, a spaced, parallel rear wall 14 and first and second sidewalls 16 and 18 (FIG. 2) extending perpendicular to the walls 12 and 14. First, second, third and fourth intermediate partitions 20, 22, 24 and 26 extend between the walls 12 and 14 in a spaced, parallel relation thereto and contain curved upper portions 20*a*, 22*a*, 24*a* and 26*a*, respectively.

The partitions 22 and 24, along with corresponding portions of the sidewalls 16 and 18, form a generally rectangular furnace section 28. A perforated air distribution plate 30 is suitably supported in the lower portion of the furnace section 28 and helps define a plenum chamber 32 extending below the furnace section. Primary air from a suitable source (not shown) is introduced into the plenum chamber 32 by conventional means through a pipe 34. The air introduced into the plenum chamber 32 passes in an upwardly direction to the air distribution plate 30 and may be preheated by air preheaters (not shown) and appropriately regulated by air control dampers (also not shown) as needed.

The air distribution plate 30 is adapted to support a bed of particulate fuel material consisting, in general, of crushed coal for burning, and limestone, or dolomite, for adsorbing the sulfur formed during the combustion of the coal. A plurality of fuel feeders 36 extend through the sidewalls 16 and 18, respectively, for introducing particulate fuel into the furnace section 28, it being understood that other pipes can be associated with the walls defining the furnace section 28 for distributing particulate sorbent material and/or additional particulate fuel material into the furnace section 28 as needed. At least one drain pipe 38 extends from the plate 30 and through openings in the furnace section 28 for discharging spent fuel and sorbent material from the furnace section 28 to external equipment.

Overfire airports 40 extend through the sidewalls 16 and 18, respectively, at a predetermined elevation above the plate 30 to introduce secondary air into the furnace section 28 for reasons to be described. It is understood that a plurality of airports such as those referred to by reference numeral 40, at one or more elevations, can be provided through any of the furnace section walls for discharging air into the furnace section 28.

First and second horizontal cyclone separators 42 and 44 are provided in an upper portion of the vessel formed by the reactor 10. The separator 42 is defined in part by the curved upper portions 20*a* and 22*a* of the walls 20 and 22, respectively and the separator 44 is defined in part by the curved upper portions 24*a* and 26*a* of the walls 24 and 26, respectively. The separator 42 has an inlet duct 46 defined by the roof 11 and the upper portion of the laterally spaced curved portion 22*a* of the partition 22 and the separator 44 has an inlet duct 48 defined by the roof 11 and the upper portion of the laterally spaced curved portion 24*a* of the partition 24. Both inlet ducts 46 and 48 extend the full width of the furnace section 28.

Two annular vortex chambers 50 and 52 are defined in the separators 42 and 44, respectively, by the curved portions 20*a* and 22*a* of the partitions 20 and 22 and the curved portions 24*a* and 26*a* of the partitions 24 and 26, respectively. Central outlet cylinders 54 and 56 extend coaxially within a portion of the vortex chambers 50 and 52, respectively, for receiving clean gases from the vortex chambers, and are of sufficient length to promote the re-entrant flow of the clean gases to exit the separators 42 and 44 to heat recovery areas 58 and 60, respectively. The vortex chambers 50 and 52 are more particularly described in allowed U.S. patent application Ser. No. 07/505,806, which is assigned to the same assignee as the present invention and is hereby incorporated by reference.

The heat recovery area 58 is defined between the sidewalls 16 and 18 and between the front wall 12 and the partition 20, and the heat recovery area 60 is defined between the sidewalls and between the rear wall 14 and the partition 26. At least one set of tube banks 62 and 64 (such as superheaters, economizers or reheaters) are disposed in each of the heat recovery areas 58 and 60, and each tube bank consists of a plurality of tubes connected in a flow circuitry via headers 62*a* and 64*a* for passing water, steam and/or a water-steam mixture (hereinafter termed "fluid") through the tubes to remove heat from the gases. Since these tube banks and their associated circuitry are conventional, they will not be described in any further detail.

Angularly-extending baffles 66 and 68 are disposed in the lower portions of the heat recovery areas 58 and 60, respectively, for directing the gases toward outlet openings 12*a* and 14*a* formed through the lower portions of the walls 12 and 14. A series of dampers 70 and a series of dampers 72 extend across each of the heat recovery areas 58 and 60, respectively, to control the flow of the gases through the heat recovery areas.

The separators 42 and 44 have outlets 74 and 76 which extend the width of the furnace section 28, are defined between the upper parallel portions of the partitions 20 and 22, and 24 and 26, respectively, at the lower portions of the vortex chambers 50 and 52. The outlets 74 and 76 communicate with troughs 78 and 80 which are defined between the partitions 20 and 22, and 24 and 26, respectively. The troughs 78 and 80 are designed to receive the separated particulate material, or solids, separated from the flue gases by the separators 42 and 44.

Figure 2:
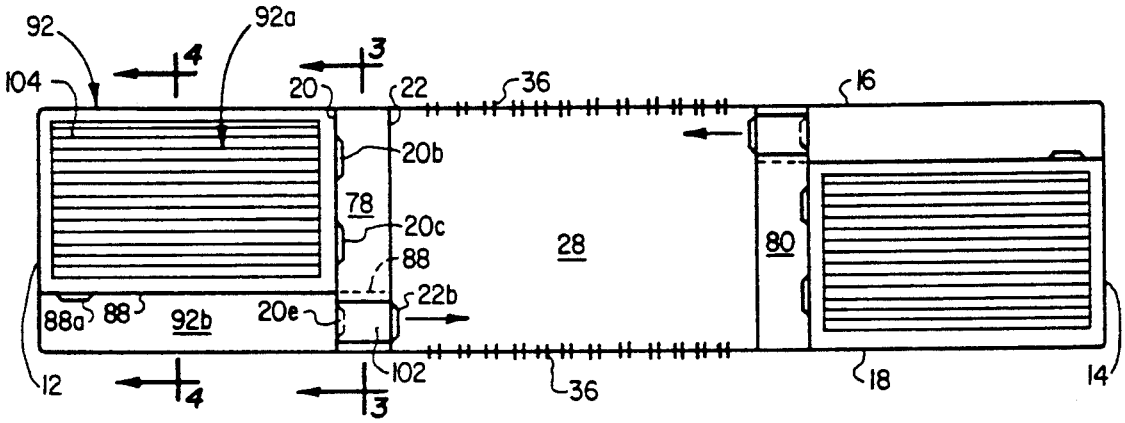
FIG. 2 is a sectional view taken along the line 2—2 of FIG. 1.

Since the right half of the reactor 10 as shown in FIGS. 1 and 2 is formed with structures which are mirror images of the structures on the left half, those structures still to be described will be described in detail only with reference to the left half of the reactor 10.

Figure 3:
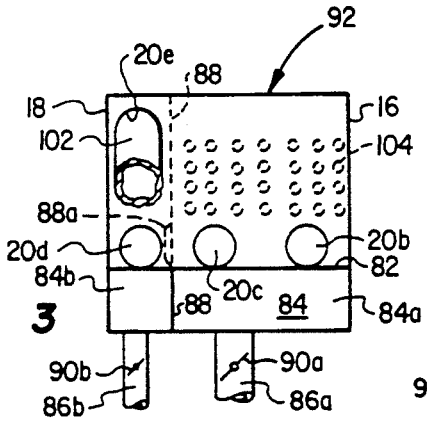
FIG. 3 is a sectional view taken along the line 3—3 of FIG. 2.
Figure 4:
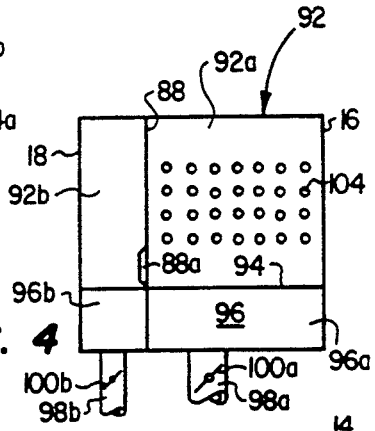
FIG. 4 is a sectional view taken along the line 4—4 of FIG. 2.

A horizontal air distribution plate 82 is suitably supported in the lower portion of the trough 78 and extends between the partitions 20 and 22 to support the solids separated from the flue gases by the separator 42. The plate 82 helps define a plenum chamber 84 extending below the trough 78 into which fluidizing air is introduced by conventional means through a pair of pipes 86*a* and 86*b* (FIG. 3). As shown in FIGS. 2–4, a vertical partition 88, extending downwardly from the plate 82 and perpendicular to the front wall 12, divides the upper portion of the plenum chamber 84 into two plenum compartments 84*a* and 84*b* with the flow of fluidizing air through the plenum compartments controlled by dampers 90*a* and 90*b*, respectively.

As shown in FIGS. 1 and 2, a heat exchange section 92 defined by the front wall 12, the partition 20 and the sidewalls 16 and 18 extends below the baffle 66 of the heat recovery area 58. A horizontal air distribution plate 94, which is similar to the plates 30 and 82, is suitably supported in the lower portion of the heat exchange section 92 and helps define a plenum chamber 96 extending below the heat exchange section 92 into which fluidizing air is introduced by conventional means through a pair of pipes 98*a* and 98*b* (FIG. 4). As shown in FIG. 4, an upward extension of the partition 88 divides the heat exchange section 92 into two segments, namely a heat recovery segment 92*a* and a seal pot segment 92*b*. The partition 88 also divides the upper portion of the plenum chamber 96 into plenum compartments 96*a* and 96*b* with the flow of fluidizing air through the plenum compartments controlled by dampers 100*a* and 100*b*, respectively.

Three spaced openings 20*b*, 20*c* and 20*d* are formed in a horizontal row through the lower portion of the partition 20 immediately above the plate 82 for passing solids from the trough 78 into the heat exchange section 92, with the openings 20*b* and 20*c* extending into the heat recovery segment 92*a* and the opening 20*d* extending into the seal pot segment 92*b*. An opening 88*a* is also formed through the partition 88 between the heat recovery segment 92*a* and the seal pot segment 92*b* immediately above the plate 94. Additionally, a downwardly slanting pipe 102 extends between an opening 20*e*, formed through the partition 20 at a higher elevation than the openings 20*b*–20*d*, and an opening 22*b* formed through the partition 22 to provide a passage from the seal pot segment 92*b* to the furnace section 28.

The openings 20*b*–20*e*, 22*b* and 88*a* are shown schematically in the drawings for the convenience of presentation, it being understood that they are actually formed in a conventional manner by cutting away the fins or bending the vertically-disposed tubes which form the partitions 20, 22 and 88 as described below.

A bank of heat exchange tubes 104 are disposed in the heat recovery segment 92*a* of the heat exchange section 92. The tubes 104 extend between headers 106*a* and 106*b* (FIG. 1) for circulating fluid through the tubes to remove heat from solids introduced into the heat recovery segment, as will be described.

The walls 12 and 14, the partitions 20, 22, 24, 26, and 88, their curved upper portions 20*a*, 22*a*, 24*a* and 26*a*, and the sidewalls 16 and 18 are each formed by a plurality of vertically-disposed tubes interconnected by vertically-disposed elongated bars, or fins, to form a contiguous, gas-tight structure. Since this type of structure is conventional, it is not shown in the drawings nor will it be described in further detail.

As shown in FIG. 1, flow circuitry is provided to pass fluid through the tubes to heat the fluid to the extent that it can be used to perform work such as, for example, driving a steam turbine (not shown). To this end, headers 108*a* and 108*b* are connected to the lower and upper ends, respectively, of the walls 12 and 14, the partitions 20, 22, 24, 26, and 88, their curved upper portions 20*a*, 22*a*, 24*a*, and 26*a*, and the sidewalls 16 and 18 for introducing fluid to, and receiving fluid from, the tubes forming the respective walls.

It is also understood that the reactor 10 is equipped with additional flow circuitry including a steam drum 110, shown in FIG. 1, and a plurality of downcomers, pipes, risers, headers, etc., some of which are shown by reference numeral 112, to provide a workable system for efficient transfer of heat from the reactor 10, including the tube banks 62, 64 and 104, as will be described.

In operation, a particulate material consisting, in general, of solid fuel like coal and limestone, is provided on the air distribution plate 30 and the fuel is ignited by light-off burners (not shown), or the like, while air is introduced into the plenum chamber 32. Additional fuel material is introduced through the fuel feeders 36 into the interior of the furnace section 28 as needed. As the combustion of the fuel progresses, additional air is introduced into the plenum chamber 32 in quantities that comprise a fraction of the total air required for complete combustion so that the combustion in the lower portion of the furnace section 28 is incomplete. The lower furnace section thus operates under reducing conditions and the remaining air required for complete combustion is supplied through the airports 40. The range of total air required for complete combustion can be supplied, for example, from 40%–90% through the plenum chamber 32 with the remaining air (10%–60%) supplied through the airports 40.

The high-pressure, high-velocity air introduced through the air distribution plate 30 from the plenum chamber 32 is at a velocity which is greater than the free-fall velocity of the relatively fine particles in the bed and is less than the free-fall velocity of the relatively course particles. Thus, a portion of the fine particles become entrained and transported by the air and the combustion gases. This mixture of entrained particles and gases rises upwardly within the furnace section 28 and passes through the inlet ducts 46 and 48 into the vortex chambers 50 and 52 of the separators 42 and 44, respectively. The inlet ducts 46 and 48 are arranged so that the mixture enters in a direction substantially tangential to the vortex chambers 50 and 52 and thus swirls around in the chambers. The entrained solid particles are thus propelled by centrifugal forces against the inner surfaces of the portions 20*a* and 22*a* defining the separator 42, and against the inner surfaces of the portions 24*a* and 26*a* defining the separator 44, where they then collect and fall downwardly by gravity through the outlets 74 and 76 and into the troughs 78 and 80, respectively.

The mixtures circulating in the vortex chambers 50 and 52 are directed to flow in a spiral fashion toward one end of the chambers, i.e., in a direction toward the sidewall 16. The pressure changes created by the spiral flows force the relatively clean gases concentrating along the central axes of the vortex chambers 50 and 56 toward the low pressure areas created at the openings of the cylinders 54 and 56. The clean gases thus pass into the cylinders 54 and 56 and exit to the heat recovery areas 58 and 60, as more particularly described in U.S. patent application Ser. No. 07/505,806 referenced above. The clean gases from the separator 42 pass through the tube bank 62 at a flow rate controlled by the dampers 70, and then exit the heat recovery area 58 via the opening 12*a* to external equipment. The clean gases from the separator 44 pass through the tube bank 64 at a flow rate controlled by the dampers 72, and then exit the heat recovery area 60 via the opening 14*a* to external equipment.

The solids which fall into the trough 80 are acted upon similarly as the solids which fall into the trough 78; therefore, only the operation of the left half of the reactor 10, as viewed in FIGS. 1 and 2, including the trough 78 will be described in detail.

During start-up, or during any other operating condition in which it is desired to return a maximum amount of the heat of the solids to the bed of the furnace section 28, such as during low loads, the dampers 90 and 100*b* are opened and the dampers 100*a* are closed to pass fluidization air from the plenum chamber 96 solely through the plenum compartment 96*b*, thereby allowing the solids in the heat recovery segment 92*a* of the heat exchange section 92 above the plenum compartment 96*a* to "slump" and block the openings 20*b* and 20*c*. Therefore, all of the solids deposited in the trough 78 pass through the opening 20*d* into the seal pot segment 92*b* of the heat exchange section 92. The solids passed to the seal pot segment 92*b* are prevented from passing through the opening 88*a* to the heat recovery segment 92*a* by the closure of the dampers 100*a* since the "slumped" solids in the heat recovery segment 92*a* also block the opening 88*a*. The dampers 100*b*, however, being simultaneously open to pass fluidization air from the plenum chamber 96 through the plenum compartment 96*b*, fluidize the solids in the seal pot segment 92*b* and carry the solids upwardly to the opening 20*e* through which the solids pass to the furnace section 28 via the pipe 102.

During steady-state operation of the reactor 10, heat is removed from the separated solids by passing them through the heat recovery segment 92*a* of the heat exchange section 92. This is accomplished by closing the dampers 90*b* while keeping open the dampers 90*a* to pass fluidization air from the plenum chamber 84 solely through the plenum compartment 84*a*, thereby allowing the solids in the trough 78 above the plenum compartment 84*b* to "slump" blocking the opening 20*d*. Further, the dampers 100*a* are simultaneously opened to fluidize the heat recovery segment 92*a*. Therefore, all of the solids deposited in the trough 78 pass through the openings 20*b* and 20*c* into the heat recovery segment 92*a* of the heat exchange section 92. The solids are carried by the fluidization air through the bank of heat exchange tubes 104, thereby transferring their heat to the fluid flowing in the tubes, thus heating the fluid and cooling the solids. As the solids travel through the heat recovery segment 92*a*, they pass through the opening 88*a* into the seal pot segment 92*b*. The seal pot segment 92*b* is fluidized to pass the solids through the opening 20*e* and the pipe 102 to the furnace section 28.

It is understood that the dampers 90*a*, 90*b*, 100*a* and 100*b* can be partially open or closed to different degrees to maximize the efficiency of the reactor 10 for any given operating parameters, and that only the extreme operating conditions have been discussed herein.

During both modes of operation, the solids accumulate in both the trough 78 and the seal pot segment 92*b* to form a head of material providing a pressure seal between the furnace section 28 and the separator 42. Thereby, the operating pressure of the furnace section 28 is sealed off from the operating pressure of the separator 42 and the backflow of solids prevented so as to minimize adverse effects to the operating characteristics of either of these two sections of the reactor 10.

Water is introduced into the tubes forming the walls 12 and 14, the partitions 20, 22, 24, 26, and 88, and their curved upper portions 20*a*, 22*a*, 24*a*, and 26*a*, and the sidewalls 16 and 18 from the lower headers 108*a*. Heat from the fluidized bed, the gas columns and the separators 42 and 44 convert a portion of the water into steam, and the mixture of water and steam rises in the tubes and collects in the upper headers 108*b*. The steam and water are then separated in a conventional manner, such as in the steam drum 110, and the separated steam is passed through additional flow circuitry to perform work, such as to drive a steam turbine, or the like (not shown), or is passed through the tubes 62 and 64 in the heat recovery areas 58 and 60, respectively, to superheat the steam prior to its passing through the turbine or reheat the steam after its passing through the turbine. The separated water is mixed with a fresh supply of feed water in the steam drum 110 and is recirculated through the flow circuitry using the conventional risers, downcomers and feeders 112.

Likewise, if additional superheating is required, steam is introduced into the tubes 104 in the heat recovery segment 92*a* of the heat exchange section 92 via the upper header 106*a*. Heat from the solids further superheats the steam in the tubes 104, and this superheated steam collects in the lower header 106*b*. This superheated steam is then routed from the lower header 106*b* through additional flow circuitry to provide extra heat capacity or directly to end use, such as for a turbine.

It is thus seen that the reactor 10 of the present invention provides several advantages. For example, the integration of two horizontal cyclone separators, two recycle heat exchangers, and two heat recovery areas, all within one vessel, permits the separation of, the removal or heat from, and the recycling of the entrained solids in a manner which reduces heat loss, as well as the need for bulky and expensive components. More particularly, the recycle heat exchangers provide additional heat to the fluid circuit associated with the reactor 10, such as a final superheat for the steam generated.

Further, the seal pot segment 92*b* of the heat exchange section 92 provides for the quick attainment of self-sustaining combustion temperatures within the furnace section. The fuel beds must originally be ignited by external means, but as the furnace temperature increases, the combustion becomes self-sustaining and the igniters can be turned off. It is therefore helpful during start-up to recycle the separated solids to the bed with a minimum of heat loss. The seal pot segment 92*b* allows the separated solids to be routed directly to the furnace section without passing over any heat exchange surfaces. Thus, the self-sustaining combustion temperature is more quickly attained. In addition, the tube banks in the recycle heat exchanger can be protected during start-up until sufficient steam can be generated by the reactor 10 to satisfactorily cool the tubes 104 to avoid exceeding the tube material design temperature.

The design of the recycle heat exchanger of the present invention also provides a pressure sealing device between the separator and the furnace section thereby preventing solids backflow and furnace section pressure fluctuations from adversely affecting the operating characteristics of both components. Further, this pressure seal is formed without extra costly or complicated structures.

In addition, the employment of horizontal cyclone separators eliminates the need for pneumatic transport devices between the separating sections and furnace section of the reactor as well as the need for many of the baffles and ducting usually required to redirect the combustion gases. Thus, the reactor 10 of the present invention is relatively compact and can be fabricated into modules for easy transportation and fast erection which is especially advantageous when the reactor is used as a steam generator, as disclosed here.

By forming the separators and the heat recovery areas within the reactor vessel, the temperature of the separator and the heat recovery area boundary walls are reduced considerably due to the relatively cool fluid passing through these walls. As a result, heat loss from the separators and the heat recovery areas is greatly reduced and the requirement for internal refractory insulation is minimized. The need for extended and expensive high temperature refractory-lined duct work and expansion joints between the reactor and cyclone separator, and between the latter and the separated solids heat exchange sections and the flue gas heat recovery areas, is also minimized. Further, this particular orientation of equipment lends itself to the design and construction of very large circulating fluidized bed steam generator systems, in the range of 500 MW and larger.

Figure 5:
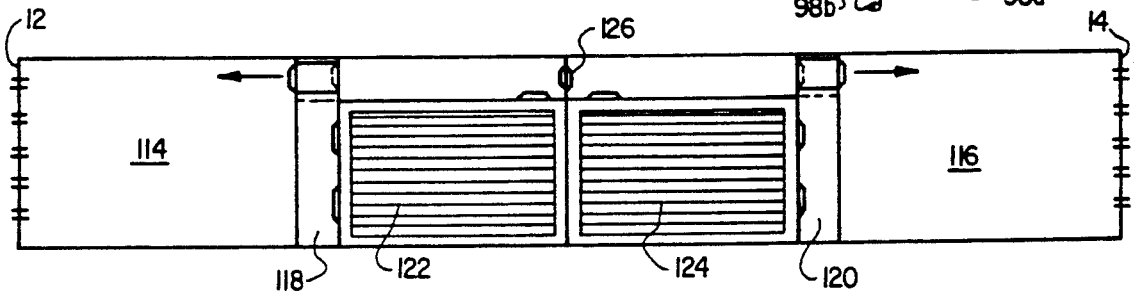
FIG. 5 is a view similar to that of FIG. 2 showing an alternative embodiment of the present invention.

It is understood that variations in the foregoing can be made within the scope of the invention. For example, the various components of the reactor 10 may be reconfigured to accommodate more than one furnace section and two connected heat exchange sections within the vessel. Specifically, and as shown in FIG. 5, the furnace section is divided into two independent furnace sections 114 and 116 located against the front and rear walls 12 and 14, respectively, rather than in the center of the vessel. A horizontal cyclone separator is disposed in the upper portion above each of the vessel furnace sections 114 and 116 to separate the solids from the flue gases. The separated solids pass into troughs 118 and 120 which pass the solids into heat exchange sections 122 and 124 disposed in the center of the vessel, the troughs and heat exchange sections being identical to those described in the preferred embodiment. The only additional feature of this embodiment is an opening 126 connecting the seal pot segments of the heat exchange sections 122 and 124 to one another.

This alternative embodiment provides all of the benefits of the preferred embodiment plus others. Particularly, to reduce output of the reactor, one can operate just one furnace section without having to run it at inefficient low load conditions. Further, the two furnace sections can be operated at different temperatures, thereby providing greater control of the temperature of the combustion gases passing through the respective heat recovery areas. In addition, the opening 126 allows for one furnace section to heat the solids and have those solids pass to the other furnace section to preheat its fluidized bed to speed the attainment of self-sustaining combustion temperatures within that furnace section.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed reactor, comprising:

a vessel;

first and second generally vertical, spaced members extending between opposite walls of said vessel for partitioning said vessel into first, second and third portions;

a furnace section disposed in said second portion and comprising means for supporting a fluidized bed of particulate solids including fuel which combusts to generate heat and a mixture of combustion gases and entrained particulate solids;

means disposed in said vessel for separating said entrained particulate solids of said mixture from said combustion gases; and first and second heat exchange means respectively disposed in said first portion and said third portion for receiving and removing heat from said separated particulate solids and said separated combustion gases.

2. The fluidized bed reactor of claim 1, wherein each of said heat exchange means comprises:

a combustion gas heat recovery area for receiving and removing heat from said separated combustion gases; and a recycle heat exchanger for receiving and removing heat from said separated particulate solids.

3. The fluidized bed reactor of claim 2, wherein each of said recycle heat exchangers comprises:

a heat recovery segment for removing heat from said separated particulate solids; and a seal pot segment for sealing against the back flow of said separated particulate solids from said furnace section to said separating means.

4. The fluidized bed reactor of claim 3, wherein said first and second members comprise ducts extending from said separating means to said recycle heat exchangers.

5. The fluidized bed reactor of claim 4 further comprising means for selectively directing said separated particulate solids in said ducts to said heat recovery segments and said seal pot segments.

6. The fluidized bed reactor of claim 4 further comprising means for independently fluidizing said ducts, said heat recovery segments and said seal pot segments for selectively directing said separated particulate solids from said ducts to said heat recovery segments and said seal pot segments.

7. The fluidized bed reactor of claim 1 wherein said separating means comprises at least one horizontally-extending cyclone separator.

8. The fluidized bed reactor of claim 1 wherein said separating means comprises at least one cyclone separator, each of said cyclone separators comprising:

curved walls to define a generally cylindrical, horizontally disposed vortex chamber for separating said entrained particulate solids from said combustion gases by centrifugal forces;

inlet means defined by said curved walls along the length of said chamber for receiving said mixture into said chamber;

outlet means defined by said curved walls along the length of said chamber for discharging said separated solids from said separating section; and a cylinder coaxially disposed within a portion of said chamber for discharging said separated combustion gases from said separating section.

9. A fluidized bed reactor comprising:

a vessel;

a furnace section disposed in said vessel and including means for supporting a fluidized bed of particulate solids including fuel which combusts to generate heat and a mixture of combustion gases and entrained particulate solids;

separating means for receiving said mixture and for separating said entrained particulate solids from said combustion gases;

a recycle heat exchanger comprising:

a trough for receiving said separated particulate solids from said separating section;

a heat recovery segment for receiving said separated particulate solids directly from said trough and removing heat from said separated particulate solids;

a seal pot segment for receiving said separated particulate solids directly from either said trough or said heat recovery segment and sealing against the back low of said separated particulate solids from said furnace section to said separating means; and means for independently fluidizing said trough, said heat recovery segment and said seal pot segment for selectively directing said separated particulate solids from said trough to said heat recovery segment and said seal pot segment, wherein said trough shares a first common wall with said heat recovery segment and said seal pot segment, and said heat recovery segment shares a second common wall with said seal pot segment.

10. A fluidized bed reaction, comprising:

a vessel;

first and second generally vertical, spaced members extending between opposite walls of said vessel for partitioning said vessel into first, second and third portions;

furnace sections respectively disposed in said first and third portions, each furnace section comprising means for supporting a fluidized bed of particulate solids including fuel which combusts to generate heat and a mixture of combustion gases and entrained particulate solids;

separating means disposed in an upper portion of said vessel for separating said entrained particulate solids of said mixture from said combustion gases; and heat exchanger means disposed in said second portion below said upper portion which receive and remove heat from said separated particulate solids and said separated combustion gases, said heat exchange means comprising:

a combustion gas heat recovery area for receiving said separated combustion gases; and a recycle heat exchanger for receiving said separated particulate solids.

11. The fluidized bed reactor of claim 10, wherein two of said heat exchange means are provided adjacent said furnace sections, respectively.

12. The fluidized bed reactor of claim 11, wherein each of said recycle heat exchangers comprises:

a heat recovery segment for removing heat from said separated particulate solids; and a seal pot segment for sealing against the back flow of said separated particulate solids from said furnace section to said separating means.

13. The fluidized bed reactor of claim 12, wherein said first and second members comprise ducts extending from said separating means to said recycle heat exchangers.

14. The fluidized bed reactor of claim 13 further comprising means for selectively directing said separated particulate solids in said ducts to said heat recovery segments and said seal pot segments.

15. The fluidized bed reactor of claim 13 further comprising means for independently fluidizing said ducts, said heat recovery segments and said seal pot segments for selectively directing said separated particulate solids from said ducts to said heat recovery segments and said seal pot segments.

16. The fluidized bed reactor of claim 10 wherein said separating section comprises at least one horizontally-extending cyclone separator.

17. The fluidized bed reactor of claim 10 wherein said separating means comprises at least one cyclone separator, each of said cyclone separators comprising:

curved walls to define a generally cylindrical, horizontally disposed vortex chamber for separating said entrained particulate solids from said combustion gases by centrifugal forces;

inlet means defined by said curved walls along the length of said chamber for receiving said mixture into said chamber;

outlet means defined by said curved walls along the length of said chamber for discharging said separated solids from said separating section; and a cylinder coaxially disposed within a portion of said chamber for discharging said separated combustion gases from said separating section.

18. The fluidized bed reactor of claim 10, wherein each of said heat exchange means comprises a recycle heat exchanger having:

a heat recovery segment for removing heat from said separated particulate solids; and a seal pot segment for sealing against the back flow of said separated particulate solids from said furnace section to said separating means.

19. The fluidized bed reactor of claim 18 further comprising means for passing said separated particulate solids between said seal pot segments.

20. The fluidized bed reactor of claim 18, wherein said seal pot segments share a common wall having an opening for passing said separated particulate solids between said seal pot segments.

21. A fluidized bed reactor comprising:

a vessel;

a furnace section in said vessel including means for supporting a fluidized bed of particulate solids including fuel which combusts to generate heat and to generate a mixture of combustion gases and entrained particulate solids;

separating means for receiving said mixture and for separating said entrained particulate solids from said combustion gases;

a first compartment for receiving said separated particulate solids from said separating section;

a second compartment partitioned into a heat recovery segment for removing heat from said separated particulate solids and a seal pot segment for sealing against the back flow of said separated particulate solids from said furnace section to said separating means; and means for independently fluidizing said first compartment and said segments for selectively directing said separated particulate solids from said first compartment directly to either said heat recovery segment or said seal pot segment.

22. The fluidized bed reactor of claim 21 wherein said separating means comprises at least one cyclone separator, each of said cyclone separators comprising:

curved walls to define a generally cylindrical, horizontally disposed vortex chamber for separating said entrained particulate solids from said combustion gases by centrifugal forces;

inlet means defined by said curved walls along the length of said chamber for receiving said mixture into said chamber;

outlet means defined by said curved walls along the length of said chamber for discharging said separated solids from said separating section; and a cylinder coaxially disposed within a portion of said chamber for discharging said separated combustion gases from said separating section.

23. The fluidized bed reactor of claim 21 further comprising:

a third compartment for receiving said separated particulate solids from said separating means;

a fourth compartment partitioned into a heat recovery segment for removing heat from said separated particulate solids and a seal pot segment for sealing against the back flow of said separated particulate solids from said furnace section to said separating means; and means for independently fluidizing said third compartment and said segments of said fourth compartment for selectively directing said separated particulate solids from said third compartment directly to either said heat recovery segment or said seal pot segment of said fourth compartment.

24. The fluidized bed reactor of claim 23 wherein said second and fourth compartments share a common wall.

25. The fluidized bed reactor of claim 24 wherein said common wall has an opening for passing said separated particulate solids between said second and fourth compartments.

26. The fluidized bed reactor of claim 23 wherein said portion of said separated particulate solids passes from said separating means to said first compartment and another portion of said separated particulate solids passes from said separating means to said third compartment.

27. The fluidized bed reactor of claim 26 wherein said separating means comprises two horizontal cyclone separators.

28. The fluidized bed reactor of claim 23 wherein said separating means and all of said compartments are disposed within said vessel.

29. The fluidized bed reactor of claim 28 further comprising a combustion gas heat recovery area disposed within said vessel for receiving said separated combustion gases.

30. The fluidized bed reactor of claim 23 wherein said first and third compartments are separated by said furnace section.

31. A fluidized bed reactor comprising:

a vessel;

a furnace section disposed in said vessel and including means for supporting a fluidized bed of particulate solids including fuel which combusts to generate heat and a mixture of combustion gases and entrained particulate solids;

separating means for receiving said mixture and for separating said entrained particulate solids from said combustion gases;

a recycle heat exchanger comprising:

a trough for receiving said separated particulate solids from said separating section;

a heat recovery segment for receiving said separated particulate solids directly from said trough and removing heat from said separated particulate solids;

a seal pot segment for receiving said separated particulate solids directly from either said trough or said heat recovery segment and sealing against the back flow of said separated particulate solids from said furnace section to said separating means;

means for independently fluidizing said trough, said heat recovery segment and said seal pot segment for selectively directing said separated particulate solids from said trough to said heat recovery segment and said seal pot segment; and a heat recovery area for receiving said separated combustion gases, said heat recovery area, said separating means and said recycle heat exchanger all being disposed within said vessel.

32. A fluidized bed reactor comprising:

a vessel;

a furnace section disposed in said vessel and including means for supporting a fluidized bed of particulate solids including fuel which combusts to generate heat and a mixture of combustion gases and entrained particulate solids;

separating means for receiving said mixture and for separating said entrained particulate solids from said combustion gases;

a recycle heat exchanger comprising:

a trough for receiving said separated particulate solids from said separating section;

a heat recovery segment for receiving said separated particulate solids directly from said trough and removing heat from said separated particulate solids;

a seal pot segment for receiving said separated particulate solids directly from either said trough or said heat recovery segment and sealing against the back flow of said separated particulate solids from said furnace section to said separating means;

means for independently fluidizing said trough, said heat recovery segment and said seal pot segment for selectively directing said separated particulate solids from said trough to said heat recovery segment and said seal pot segment; and a second recycle heat exchanger identical to said first recycle heat exchanger and sharing a common wall therewith, said common wall having an opening for passing said separated particulate solids from one recycle heat exchanger to said other recycle heat exchanger.

* * * * *

UNITED STATES PATENT AND TRADEMARK OFFICE

CERTIFICATE OF CORRECTION

PATENT NO. : 5,325,823
DATED : July 5, 1994
INVENTOR(S) : Juan A. Garcia-Mallol

It is certified that error appears in the above-indentified patent and that said Letters Patent is hereby corrected as shown below:

Column 13, line 58, "low" should be --flow--.

Column 14, line 3, "reaction" should be --reactor--.

Signed and Sealed this

Ninth Day of May, 1995

Bruce Lehman

*Attest:*

BRUCE LEHMAN

*Attesting Officer*

*Commissioner of Patents and Trademarks*